US006811441B2

(12) United States Patent
Simpson

(10) Patent No.: US 6,811,441 B2
(45) Date of Patent: Nov. 2, 2004

(54) ELECTRICAL CABLE STRAIN RELIEF AND ELECTRICAL CLOSURE

(75) Inventor: Jeffrey S. Simpson, Mechanicsburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/417,521

(22) Filed: Apr. 17, 2003

(65) Prior Publication Data

US 2003/0211780 A1 Nov. 13, 2003

Related U.S. Application Data

(60) Provisional application No. 60/379,353, filed on May 10, 2002.

(51) Int. Cl.[7] ..... H01R 9/03

(52) U.S. Cl. ..... 439/610; 439/464; 439/465; 439/457

(58) Field of Search ..... 439/610, 460, 439/464, 465, 457

(56) References Cited

U.S. PATENT DOCUMENTS

| | | | | |
|---|---|---|---|---|
| 4,025,145 A | | 5/1977 | Shaffer et al. | |
| 4,272,148 A | | 6/1981 | Knack, Jr. | |
| 4,399,318 A | | 8/1983 | Waters | 174/35 |
| 4,808,128 A | | 2/1989 | Werth | 439/610 |
| 4,822,304 A | * | 4/1989 | Herron | 439/610 |
| 4,887,971 A | | 12/1989 | Reuss et al. | 439/98 |
| 4,902,248 A | * | 2/1990 | Robertson | 439/610 |
| 4,916,804 A | | 4/1990 | Yoshimura et al. | 29/592.1 |
| 4,929,189 A | | 5/1990 | Sekiguchi | 439/352 |
| 4,963,104 A | * | 10/1990 | Dickie | 439/460 |
| 5,222,909 A | | 6/1993 | Nomura et al. | 439/607 |
| 5,267,878 A | * | 12/1993 | Shinji et al. | 439/610 |
| 5,718,608 A | * | 2/1998 | Guiol | 439/610 |
| 5,833,495 A | | 11/1998 | Ito | 439/610 |
| 6,302,724 B1 | | 10/2001 | Meller | 439/457 |
| 6,439,929 B1 | * | 8/2002 | Jenets | 439/610 |
| 6,530,789 B2 | * | 3/2003 | Konda | 439/98 |

* cited by examiner

*Primary Examiner*—Tho D. Ta
(74) *Attorney, Agent, or Firm*—Lanier Ford Shaver & Payne P.C.

(57) ABSTRACT

Disclosed herein are methods and apparatus for providing a strain relief for use in the assembly of an electrical connector on an end of an electrical conductor having at least an outer braided portion, which may be surrounded by an insulating cover. The methods and apparatus disclosed herein provide a low cost approach for installation using minimal tooling, while providing a precise and robust relief that ensures electrical performance.

19 Claims, 5 Drawing Sheets

FIG. 1
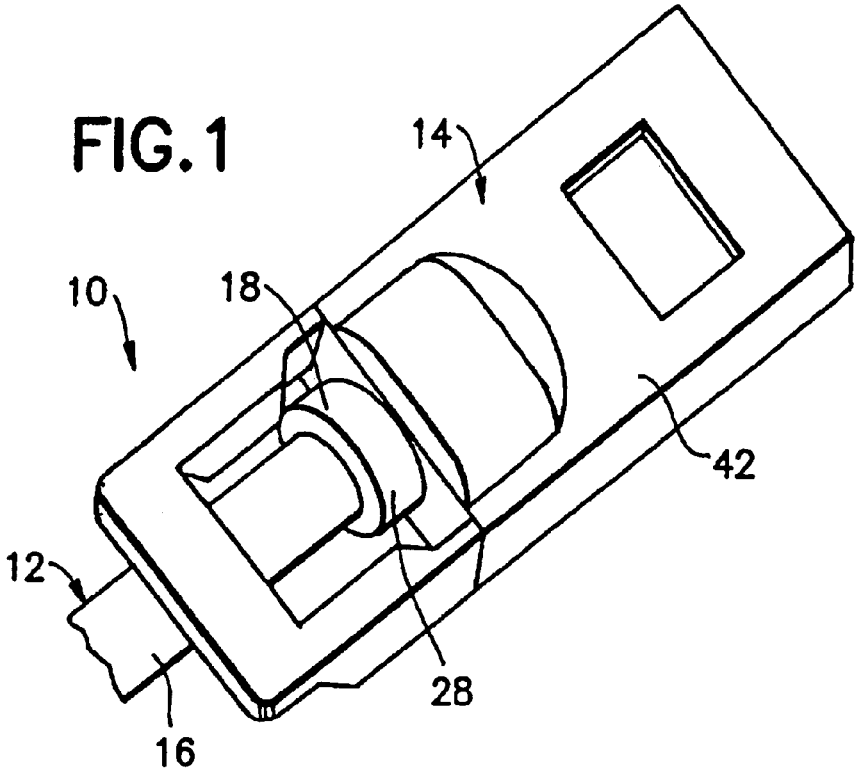
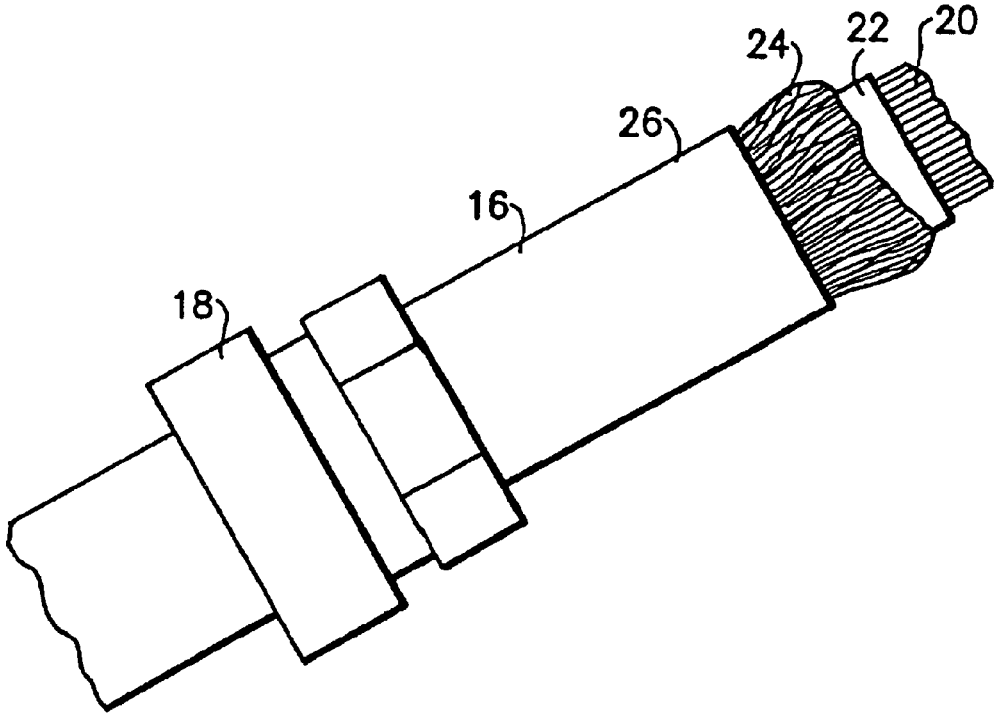
FIG. 2

ELECTRICAL CABLE STRAIN RELIEF AND ELECTRICAL CLOSURE

CROSS REFERENCE TO RELATED APPLICATION

This application claims priority under 35 U.S.C. 119(e) to U.S. Provisional Patent Application No. 60/379,353, filed May 10, 2002.

BACKGROUND OF THE INVENTION

1. Field of the Invention

The present invention relates to electrical connectors and, more particularly, to a strain relief used in an electrical connector and conductor assembly.

2. Brief Description of Prior Developments

In some conventional electrical connector and cable assemblies, the most common way to electrically join the cable braid to the metal shell is to crimp a metal ferrule over the braid, and compress the ferrule slightly when the shell is closed. Typically, crimping is completed manually, and therefore is imprecise.

There is a concern with this type of system in that over crimping the wire pairs could damage the dielectric, such as in the case where too great a crimping force is applied. For example, degradation in electrical performance can result from applying excessive force during the crimping. There is also a concern that crimping to the soft jacket is not a reliable strain relief should the cable be pulled away from the connector.

SUMMARY OF THE INVENTION

The present invention provides a solution to these problems and others. The techniques disclosed herein provide for a strain relief that can be tailored to meet a specific need. With better control over aspects of the manufacture and installation of the strain relief, better control over electrical performance and other aspects are achieved.

In embodiments of the strain relief disclosed herein, the strain relief provides additional benefits. For example, in one embodiment of the strain relief disclosed herein, little or no additional tooling is required for installation of the strain relief, thus improving installation time and reducing installation expenses while maintaining electrical performance. Multiple strain reliefs may be manufactured, with little additional expense. Furthermore, distribution of multiple size strain reliefs can be accomplished with minimal handling.

In one embodiment, an overmolded strain relief is provided. The use of a low pressure overmolding process does not damage the wires of the cable. In an alternate embodiment of the present invention, rather than overmolding the strain relief onto the cable, a slip-on strain relief is provided and is subsequently slipped onto the cable.

BRIEF DESCRIPTION OF THE DRAWINGS

FIG. 1 is a perspective view of an end of an electrical connector and cable assembly incorporating features of the present invention;

FIG. 2 is a perspective view of the cable and strain relief shown in FIG. 1 before attachment to the electrical connector;

DETAILED DESCRIPTION OF THE PREFERRED EMBODIMENT

Figure 3:
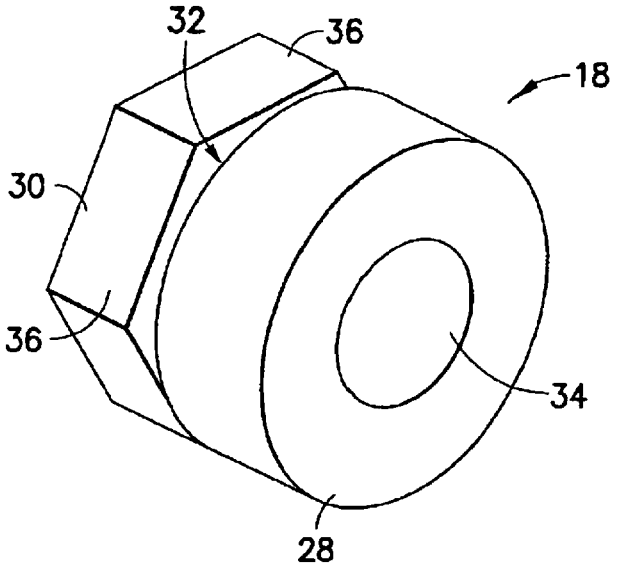
FIG. 3 is a perspective view of the strain relief shown in FIG. 1.
Figure 4:
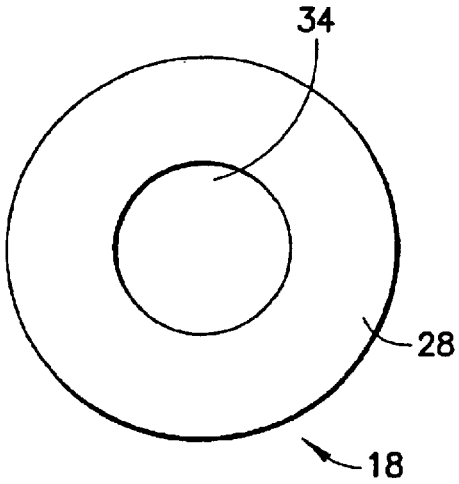
FIG. 4 is a rear elevational view of the strain relief shown in FIG. 3.
Figure 5:
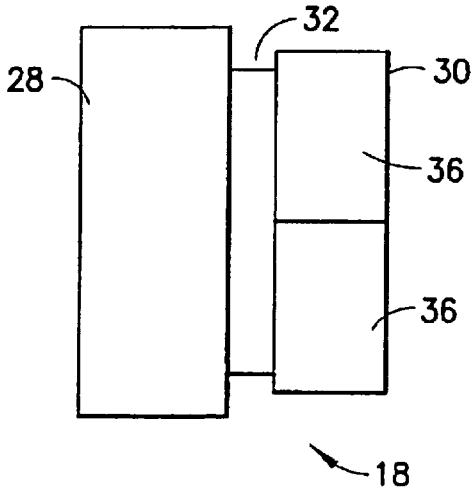
FIG. 5 is a side elevational view of the strain relief shown in FIG. 3.
Figure 6:
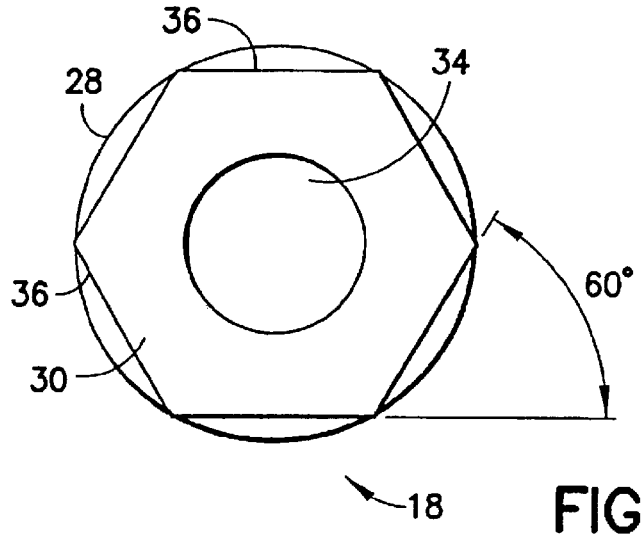
FIG. 6 is a front elevational view of the strain relief shown in FIG. 3.

Referring to FIG. 1, there is shown a perspective view of an end of an electrical connector and cable assembly 10 incorporating features of the present invention. Although the present invention will be described with reference to the exemplary embodiments shown in the drawings, it should be understood that the present invention can be embodied in many alternate forms of embodiments. In addition, any suitable size, shape or type of elements or materials could be used.

The strain relief is generally discussed in reference to FIGS. 2–6 as a one-piece overmolded strain relief 18. Further aspects of a second and preferred embodiment, that of a slip-on strain relief 77, 79, 81, are discussed in reference to FIGS. 7–10.

The electrical connector and cable assembly 10 generally comprises an electrical conductor assembly 12 and an electrical connector 14. Referring also to FIG. 2, the electrical conductor assembly 12 generally comprises an electrical conductor cable 16, and a low pressure overmolded strain relief 18. The cable 16 is a common electrical conductor cable. The cable 16 generally comprises a plurality of electrical conductors 20, an inner insulator 22, an electrically conductive outer braid 24, and an outer insulator cover 26. In the embodiment shown, the cable comprises pairs of conductors surrounded by individual insulating covers and a cover over each pair of conductors and covers. However, in alternate embodiments, any suitable type of electrically conductive cable could be provided.

In one embodiment, the strain relief 18 is overmolded onto the outer insulator cover 26. In one embodiment, the strain relief 18 is overmolded by a low pressure molding process. A mold is closed over the cable 16. A low pressure material, such as a thermoplastic, fills the cavity of the mold. Non-limiting examples of suitable materials include polypropylene and 6-6 Nylon™. After curing, the mold is opened leaving the remaining casting 18.

Referring also to FIGS. 3–6, the strain relief 18 is formed as a one-piece molded plastic or polymer member. The strain relief 18 generally comprises a rear section 28, a front section 30, a recessed area 32 between the front section and the rear section, and a center aperture 34. The center aperture 34 extends through the strain relief 18 between its front end and its rear end.

The rear section 28, in the embodiment shown, comprises a general round ring shape. The rear section comprises a generally flat or smooth exterior end surface portion. However, in alternate embodiments, any suitable shape could be provided. The front section 30 comprises a general ring shape with a general hexagon outer shape. The front section also comprises a generally flat or smooth exterior end surface portion. The hexagon outer shape provides flat surfaces 36 on the outer sides of the front section. In alternate embodiments, the front section could comprise any suitable type of polygonal shape, or could comprise any suitable type of shape which includes at least one flat surface or a surface contoured to mate with a mating surface of the electrical connector shell (with a portion of the braid 24 therebetween) as further described below.

Figure 7:
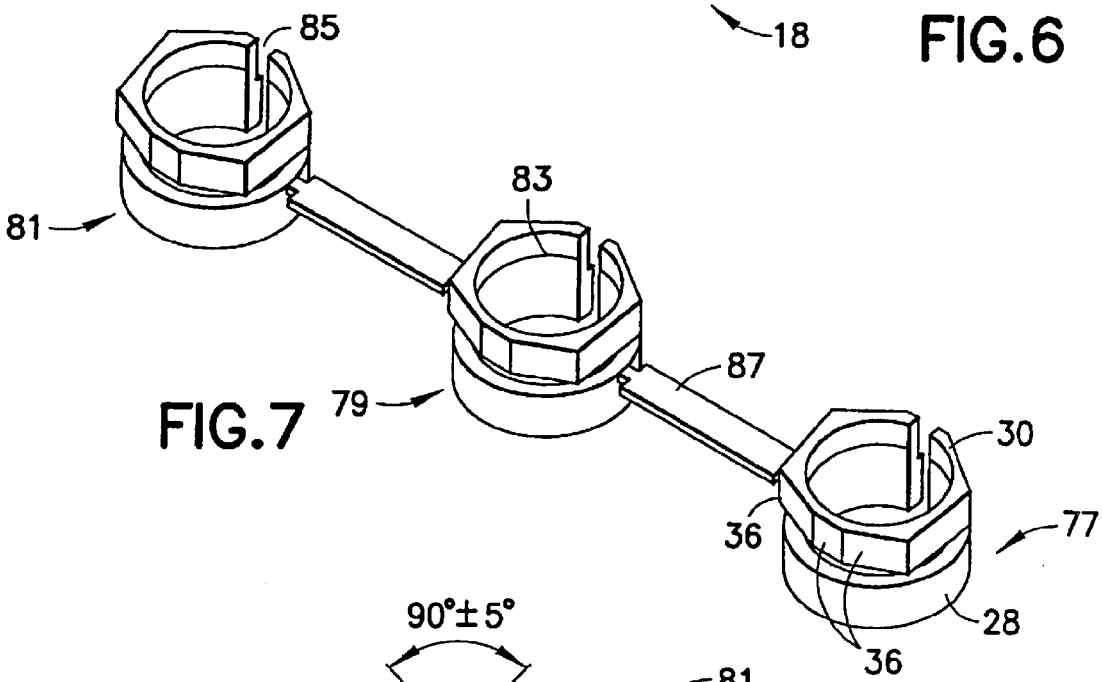
FIG. 7 is a perspective view of a second embodiment of the strain relief where three strain reliefs appear on a single strip.

Referring to FIG. 7, a second embodiment of the strain relief is shown. In FIG. 7, a set of three strain reliefs 77, 79, 81 are shown as produced together in one separate molding process. The strain reliefs 77, 79, 81 are shown as connected by excess material in the form of flashing 87 resulting from molding. The flashing 87 may be left in place for neatly grouping the strain reliefs 77, 79, 81, such as for distribution purposes. In one embodiment, an array of various size strain reliefs 77, 79, 81 are produced as a set, wherein the set is distributed as shown in FIG. 7. This embodiment may be useful in various situations, such as where a user needs to ensure availability of an appropriately sized strain relief 77, 79, 81 during assembly of connectors for various cable sizes.

As shown in FIG. 7, a slip-on strain relief 77, 79, 81 includes certain features not included in the overmolded strain relief 18. The slip-on strain relief 77, 79, 81 generally has a hollow cylindrical form, which includes a gap 85 along one side of the strain relief 77, 79, 81. Teeth 83 may be included for providing gripping power relative to the insulation 26 of the cable 16. In order to install the strain relief 77, 79, 81, and to provide for proper form once under compression, the slip-on strain relief 77, 79, 81 includes a gap 85. The gap 85 runs from the front section 30 to the rear section 28, thus creating a break in the wall of the strain relief 81. Accordingly, the slip-on strain relief 77, 79, 81 has a "C" cross sectional shape. Aspects of the gap 85 may be determined based upon factors such as, without limitation, the size of the cable 16, and the degree of compression desired for use with a given connector 14.

Figure 8:
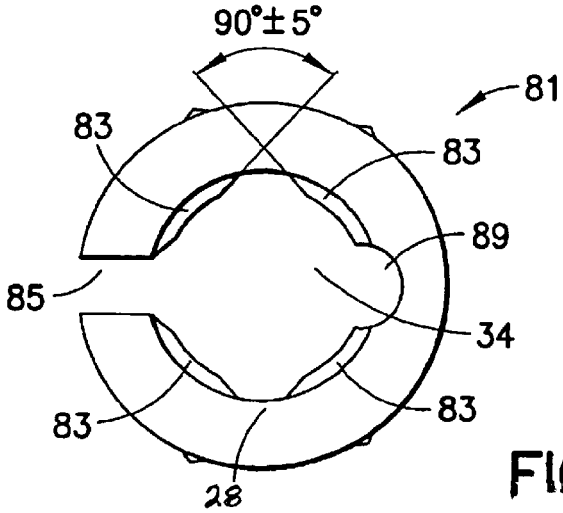
FIG. 8 is a rear elevational view of a single strain relief as shown in FIG. 7.

As shown in FIG. 8, the rear elevational view of the strain relief 81, a detent 89 may be included. The detent 89 is located on the interior portion of the strain relief 77, 79, 81 along the center aperture 34. The detent 89 may be incorporated to provide flexibility in the strain relief 77, 79, 81. The flexibility may be advantageous for permitting a greater width of the gap 85 during installation. That is, the detent 89 makes it easier to separate the walls of the strain relief 81 and to increase the size of the gap 85. More or less than one detent 89 may be included. The detent 89 generally runs the length of the strain relief 81, however, the detent 89 may be shorter than the entire length of the strain relief 77, 79, 81.

In one embodiment, the detent 89 is sized or otherwise configured so that the strain relief 81 is balanced under compression. That is, the detent 89 is configured so as to mimic the properties of the gap 85. In other embodiments, the reverse is true. That is, the gap 85 is configured to provide balanced compression in light of requirements for the detent 89.

Also shown in FIG. 8, four teeth 83 are present. The teeth 83 are located on the interior portion of the strain relief 81 along the center aperture 34. The teeth 83 may be more or less in number. Referring back to FIG. 7, the teeth 83 are also shown as being of one course. In other embodiments, more than one course of teeth 83 may be used. Further, in the embodiment shown in FIG. 8, the teeth 83 are circumferentially distributed, or placed, so as each one is separated about 90° from the next. In other embodiments, the teeth 83 are otherwise circumferentially distributed.

Figure 9:
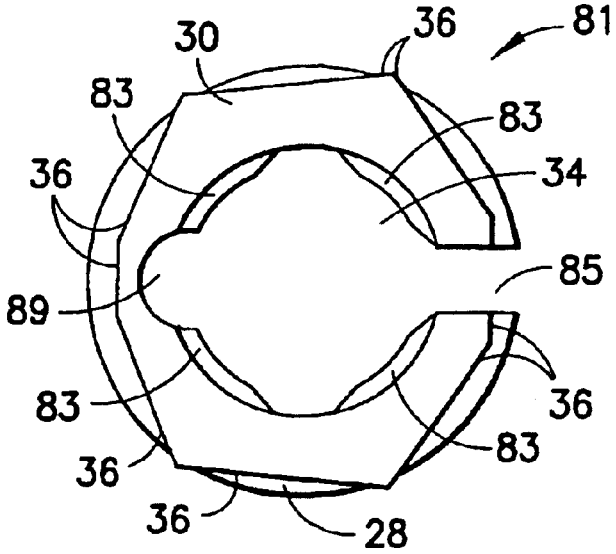
FIG. 9 is a front elevational view of a single strain relief as shown in FIG. 7.

FIG. 9 provides a front elevational view of the strain relief 81. In this view, other features of the strain relief 81 are apparent, such as the flat surfaces 36 that are shown in the embodiment depicted in FIG. 6.

Figure 10:
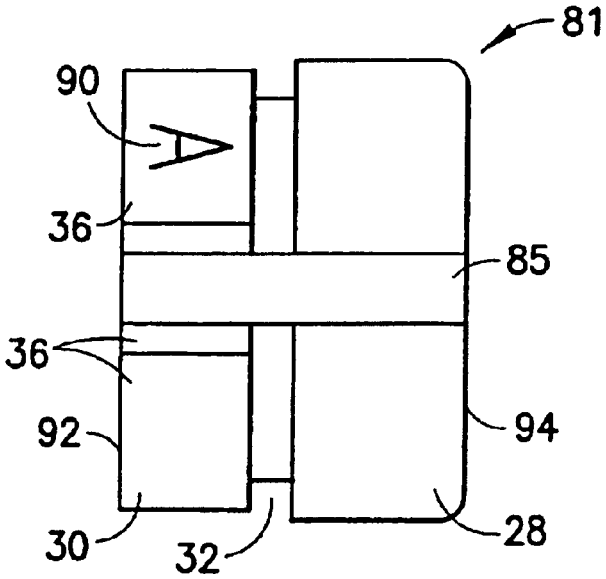
FIG. 10 is a side view of a single strain relief as shown in FIG. 7; and, FIG. 11 is a partially exploded perspective view of the electrical connector and cable assembly shown in FIG. 1.

FIG. 10 provides a side view of the strain relief 81. In this side view, indicia 90 are also shown. The indicia 90 may be applied as a recess during the separate molding, may be stamped, embossed, or otherwise applied to the strain relief 77, 79, 81. The indicia 90, or multiples thereof, may be used for coding and conveying a variety of information. For example, in one embodiment, a code conveys size information to a user, in another embodiment, a code conveys lot information to a manufacturer. In other embodiments, color coding techniques may be used, wherein aspects of the strain relief 77, 79, 81 may be determined according to the color of the strain relief 77, 79, 81. The smooth or flat front end surface 92 and the smooth or flat rear end surface 94 are shown in FIG. 10.

Mounting the strain relief may be accomplished manually or remotely with appropriate tooling. In some embodiments, the slip-on strain relief 81 may be slipped on over an end of a cable 16, at an appropriate time such as prior to conductor assembly. In other embodiments, the gap 85 of the slip-on strain relief 77, 79, 81 is forced at least partially open so as to provide for lateral insertion of the cable 16 into the strain relief 77, 79, 81. The opening force on the strain relief 77, 79, 81 is subsequently released. Then, the strain relief 77, 79, 81 substantially returns to the form of the strain relief 77, 79, 81 prior to application of the opening force. In this manner, the strain relief 77, 79, 81 is "slipped" onto the cable 16. Preferably, the strain relief 77, 79, 81 does not snap onto or lock into itself.

Figure 11:
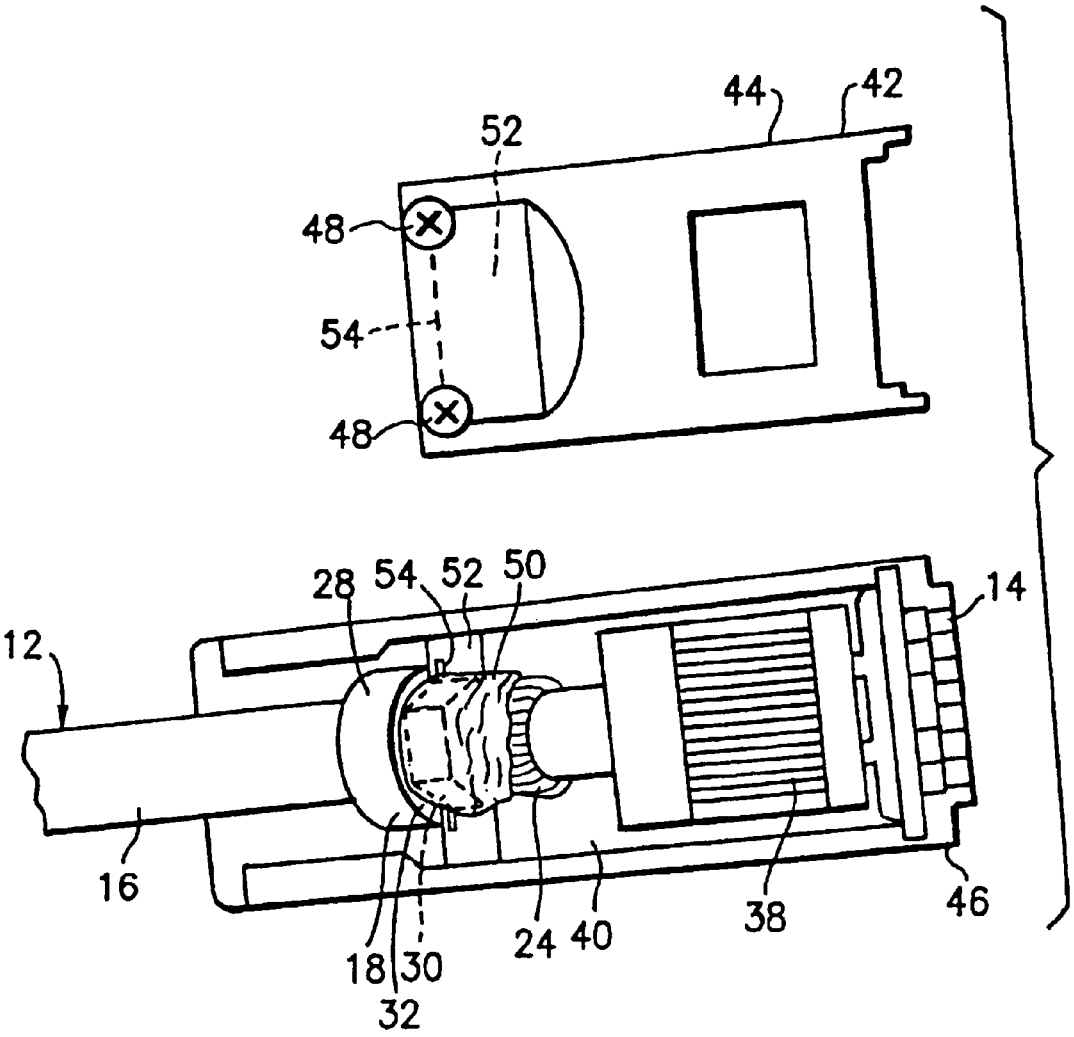

Referring now to FIG. 11, the conductor assembly 12 is shown partially attached to the electrical connector 14. The electrical connector 14 generally comprises a plurality of electrical contacts 38, a housing 40, and an electrically conductive shell 42. The shell 42, in the embodiment shown, comprises two half pieces 44, 46 which are attached to each other over the housing 40 by fasteners 48. In alternate embodiments, the shell could comprise any suitable number of pieces, the pieces could comprise any suitable size or shape, and the pieces could be fixedly attached to each other and/or the housing by any suitable means. In the embodiment shown in FIG. 11 the first half piece 44 of the shell 42 is shown removed from the connector to show the connection of the conductor assembly 12 with the connector 14. The half pieces 44, 46 comprises interior facing flat sections 52 and projecting ribs 54 which oppose each other. The ribs 54 are formed by the inwardly projecting rear end walls of the shell pieces 44, 46.

The electrical conductors 20 of the cable 16 are attached to the electrical contacts 38 of the connector 14. A suitable portion of the outer cover 26 of the cable 16 in front of the overmolded strain relief 18 or the slip-on strain relief 77, 79, 81 is removed to allow the exposed section of the braid 24 to be folded backward onto the strain relief 18, 77, 79, 81. The braid 24 is folded back over the front section 30 and into the recessed area 32.

In the embodiment shown, the conductor assembly 12 further comprises electrically conductive tape 50. The tape 50 is attached to the braid 24 to prevent strands of the braid from spreading out. In a preferred embodiment, the electrically conductive tape comprises a metallized copper tape. However, in alternate embodiments, any suitable type of electrically conductive fastener for fixedly retaining the braid 24 at the front section 30 and the recessed area 32 of the strain relief 18, 77, 79, 81 could be provided. In an alternate embodiment, the tape or other braid end fastener might not be provided.

When the half pieces 44, 46 of the shell 42 are attached to each other in the finalized assembly, the projecting ribs 54 extend into the recessed area 32 of the strain relief to sandwich a portion of the braid 24 between the strain relief 18, 77, 79, 81 and the shell 42 in the recessed area 32. If the tape 50 is located at the recessed area 32, that portion of the tape is also sandwiched between the strain relief 18, 77, 79, 81 and the shell 42. The flat sections 52 of the shell 42 sandwich the tape 50 and the braid 24 between the shell 42 and the strain relief 18, 81 against two opposite ones of the flat surfaces 36 of the front section 30 of the strain relief 18, 77, 79, 81. This causes the shell 42 to capture the strain relief 77, 79, 81, compress it into its final position, thus forming an electrical connection between the braid and the shell.

In the embodiment shown, the strain relief 18, 77, 79, 81 is a one-piece member, but serves three purposes. The hexagon shape of the front section 30 creates the form where the cable braid can be compressed by the metal shells. The center recessed area is used to trap the metal braid with the metal shells to prevent the cable from being pulled out of the connector 14. The rear section 28 prevents the cable 12 from being pushed into the connector 14, and perhaps damaging the connection between the conductors 20 and the contacts 38.

In some conventional electrical connector and cable assemblies, the most common way to electrically join the cable braid to the metal shell is to crimp a metal ferrule over the braid, and compress the ferrule slightly when the shell is closed. There is a concern with this type of system in that crimping over the wire pairs could damage the dielectric; causing degradation in the cable assembly performance. There is also a concern that crimping to the soft jacket 26 is not a reliable strain relief should the cable be pulled away from the connector.

The present invention provides a solution to these problems by providing a plastic strain relief. The plastic strain relief may be overmolded onto the cable 16. The use of a low pressure overmolding process does not damage the wires of the cable. In an alternate embodiment of the present invention, rather than overmolding the strain relief 18 onto the cable 16, a slip-on strain relief 77, 79, 81 is supplied which is subsequently slipped onto the cable 16.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical conductor assembly comprising:

an electrical conductor cable comprising at least one electrical conductor and an electrically conductive braid;

a strain relief mounted on the cable, the strain relief comprising a rear section, a front section with an outer hexagon shape, and a recessed area between the rear section and the front section, wherein the electrical conductive braid is folded back over the front section and into the recessed area; and electrically conductive tape on the electrically conductive braid to prevent strands of the braid from spreading out.

2. An electrical conductor assembly as in claim 1 wherein the electrically conductive tape comprises metallized copper tape.

3. An electrical conductor assembly as in claim 1 wherein the strain relief comprises an overmolded strain relief.

4. An electrical conductor assembly as in claim 1 wherein the strain relief is formed of material comprising a low pressure material.

5. An electrical conductor assembly as in claim 1 wherein the strain relief is formed of thermoplastic material.

6. An electrical conductor assembly as in claim 1 wherein the strain relief comprises a slip-on strain relief.

7. An electrical conductor assembly as in claim 6 wherein the strain relief comprises a gap in the wall of the strain relief.

8. An electrical conductor assembly as in claim 6 wherein the strain relief comprises at least one tooth disposed on the interior portion of the strain relief.

9. An electrical conductor assembly as in claim 6 wherein the strain relief comprises at least one detent disposed on the interior portion of the strain relief.

10. An electrical conductor assembly and cable assembly comprising:

an electrical conductor assembly as in claim 1; and an electrical connector connected to an end of the electrical conductor assembly, the electrical connector comprising at least one contact connected to the at least one electrical conductor, and at least one electrically conductive shell directly contacting at least one of the electrically conductive tape and the electrically conductive braid in the recessed area.

11. A method for assembling an electrical connector, the method comprising:

selecting an electrical conductor cable comprising at least one electrical conductor and an electrically conductive braid;

mounting a strain relief onto the cable, the strain relief comprising a rear section, a front section with an outer hexagon shape, and a recessed area between the rear section and the front section; and folding back the electrical conductive braid over the front section and into the recessed area.

12. A method as in claim 11, wherein mounting a strain relief comprises snapping the strain relief onto the cable.

13. A method as in claim 11, further comprising:

applying electrically conductive tape on the electrically conductive braid to prevent strands of the braid from spreading out.

14. A method as in claim 13, further comprising:

attaching an electrically conductive shell over at least a portion of the electrical conductor, the strain relief and the conductive tape.

15. A method as in claim 11, wherein mounting a strain relief comprises overmolding the strain relief onto the cable.

16. A method as in claim 15, wherein overmolding comprises a low pressure molding process.

17. A one-piece strain relief for an electrical conductor comprising:

a hollow cylindrical form having an interior portion, the form comprising a gap along one side running a length of the form;

a rear section of the form comprising a flat end surface;

a front section of the form comprising at least one flat end surface, and further comprising a hexagon outer shape;

a recessed area between the rear section and the front section, the recessed area being adapted for receipt of an electrical conductive braid.

18. A one-piece strain relief as in claim 17 wherein the strain relief comprises at least one tooth disposed on the interior portion.

19. A one-piece strain relief as in claim 17 wherein the strain relief comprises at least one detent disposed on the interior portion.

* * * * *